US006619076B2

(12) United States Patent
Boling

(10) Patent No.: US 6,619,076 B2
(45) Date of Patent: Sep. 16, 2003

(54) METHOD AND APPARATUS FOR COOKING STARCH

(76) Inventor: David W. Boling, 293 N. Highland, Jackson, TN (US) 38301

( * ) Notice: Subject to any disclaimer, the term of this patent is extended or adjusted under 35 U.S.C. 154(b) by 18 days.

(21) Appl. No.: 09/975,778

(22) Filed: Oct. 12, 2001

(65) Prior Publication Data

US 2003/0074930 A1 Apr. 24, 2003

(51) Int. Cl.[7] ..... D06F 39/02
(52) U.S. Cl. ..... 68/17 R; 68/207; 127/28
(58) Field of Search ..... 127/28, 71; 8/159; 68/13 R, 17 R, 207

(56) References Cited

U.S. PATENT DOCUMENTS

| | | | | |
|---|---|---|---|---|
| 1,157,738 A | | 10/1915 | Tyler | |
| 1,190,690 A | | 7/1916 | Tyler | |
| 1,411,934 A | | 4/1922 | Rankin | 127/28 |
| 1,418,320 A | | 6/1922 | Miller | 127/28 |
| 2,253,262 A | | 8/1941 | Bierly | 127/28 |
| 2,452,142 A | | 10/1948 | Pecker | 127/28 |
| 2,516,884 A | | 8/1950 | Kyame | 127/28 |
| 2,730,468 A | | 1/1956 | Martin | 127/28 |
| 2,929,748 A | * | 3/1960 | Schwandt | |
| 2,940,876 A | | 6/1960 | Elsas | 127/28 |
| 3,527,606 A | * | 9/1970 | Taylor et al. | |
| 3,661,640 A | | 5/1972 | Griffith et al. | 127/28 |
| 5,390,385 A | | 2/1995 | Beldham | 8/158 |
| 5,437,169 A | | 8/1995 | Mitchell et al. | 68/17 |
| 5,680,663 A | | 10/1997 | Mitchell et al. | 8/159 |
| 5,964,950 A | | 10/1999 | Boling | 127/28 |

* cited by examiner

*Primary Examiner*—Frankie L. Stinson
(74) *Attorney, Agent, or Firm*—Wyatt, Tarrant & Combs, L.L.P.

(57) ABSTRACT

A method and apparatus for cooking a starch solution and then dispensing that cooked starch solution to a commercial laundry washer provides a vessel with an interior surrounded by a wall for holding a volume of liquid, a water supply inlet for supplying water to the vessel interior, an opening for adding dry starch to the vessel interior, and a steam supply inlet for adding steam to the vessel interior so that the volume of liquid within the vessel can be heated. A level controller controls the level of fluid within the vessel in between the minimum and maximum levels that is fabricated of a generally low or non-heat conductive material. A recirculation flow line has an inlet and outlet that each communicate with the vessel interior. A centrifugal pump mounted in the recirculation flow line pumps fluid from the inlet to the outlet in a recirculating fashion, the pump having a filter disposed on the inlet side within the vessel that breaks up starch lumps flowing in the recirculation flow line. A discharge flow line transmits the heated starch solution from the vessel interior to the commercial laundry washer.

13 Claims, 2 Drawing Sheets

METHOD AND APPARATUS FOR COOKING STARCH

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to an improved method and apparatus for cooking starch that is to be used in a commercial laundry application. Even more particularly, the present invention relates to an improved commercial starch cooking method and apparatus wherein a recirculating flow line reticulates the cooking starch solution through a recirculating pump at velocities of flow not previously achieved in starch cooking apparatus which promotes a more uniform heating of the starch batch and breaks up lumps in the starch. In the preferred embodiment of the invention, the starch is caused to exit the cooker at high velocity through a strainer in the form of a standpipe in the bottom center of the cooker vessel by a high velocity centrifugal circulating pump which discharges back into the vessel through a spray nozzle adjacent the periphery of the vessel thereby establishing a high velocity circulation of fluid in the vessel causing a vortex to be exhibited around the discharge standpipe to continually mix and homogenize the starch, and clean the vessel wall.

2. General Background of the Invention

During the cooking of starch two phenomena take place. Naturally occurring starch granules undergo considerable physical change, usually "swelling," until they are complete disintegrated, and the starch molecules are hydrolyzed into smaller particles. The resulting modified starch material depends upon processing conditions that are very important in determining the physical characteristics of the final starch solution. The swelling or hydrolyzed modification of starch, if precisely controlled, allows starch to be useful as a size or adhesive.

A compact cooker, reliably and consistently operable by a relatively unsophisticated individual, would be desirable. At a minimum, the cooker should bring the water and starch charge to a workable temperature and maintain the mix in a status for dispensing into the laundry apparatus. For effective starching of clothing, it is essential that the starch be a homogenous mix of water and starch, that is, without lumps or other concentrations of starch which present an uneven texture or appearance to the fabric of the washed and starched garment. It is customary in "cooking starch" for laundry purposes to utilize temperatures in the 165° Fahrenheit thru 190° Fahrenheit range (preferably between 180° F. to 190° F.). At higher temperatures, i.e., above 212° F., the chemical and physical make up of the starch continues to change in such that the starch molecules begin to swell causing the volume of slurry to increase. As temperatures continue to rise, the starch molecules "burst" and the starch slurry no longer has the desirable properties as a sizing or adhesive.

The cooker must repeatedly perform the fill, cook and empty tasks with precision and regularity inherent in the design and operation of the machine and thus, without say sort of individual monitoring of the progress of the cooking procedure.

Several patents have issued for starch cooking devices. Some of the suggested patented systems require the use of a tank float device (e.g., U.S. Pat. No. 5,437,169 to Mitchell) to open and close the water supply valve via a solenoid. The float is immersed or partially immersed in the aqueous slurry of starch. Immersed operating components in starch solutions are a source of operating trouble. If the float becomes coated with starch, it fails to function, and presents overflow risks.

Some existing starch cookers (e.g., U.S. Pat. No. 5,437,169 to Mitchell; U.S. Pat. No. 2,730,468 to F. H. Martin; and U.S. Pat. No. 1,418,320 to E. W. Miller) use direct steam injection both to cook the starch and to agitate the starch solution. Existing cookers that use steam both to agitate and to cook often create starch solutions having lumps. It is believed that the concentrated heat of the steam directly on the starch solution causes localized heating and a temperature above that which the starch will remain stable as described above. These starch lumps cause uneven starching of the garments and a build up of starch on the press covers when the garments are pressed. Furthermore, direct steam induction results in sediment from within the boiler and or steam line to be mixed with the starch solution resulting in contamination (granular inclusions) and discoloration of the garments.

Other existing starch cookers (e.g., U.S. Pat. No. 5,437,169 to Mitchell, U.S. Pat. No. 2,940,876 to N. E. Elsas; and U.S. Pat. No. 2,516,884 to G. J. Kyame) use a plurality of valves to direct the contents of the containment tank either to the output conduit or the tank circulation. Problems have resulted from starch building up on such valves, including a failure of the valve to function.

Further problems with existing starch cookers involve the use of microprocessors to control a plurality of relays and process signals from various controlled communications. Microprocessors are particularly susceptible to heat and moisture, both of which are abundantly present in commercial laundries. When microprocessors are exposed to only minute amounts of moisture and/or heat they often cease to function. Thus, it would is desirable to provide a starch cooker which does not have the aforesaid susceptibility to heat and moisture.

Some large laundries use large vats of hot starch solutions and manually transfer hot starch from the vat to the washer. The manual transfer presents a danger of spillage and burning the operator. Another problem with this method is the large size of the vats and the consequently large quantities of starch. If the entire amount of starch is not used the same day it is prepared, the residual will frequently spoil and impart an unpleasant odor to the garments.

Other unsuccessful approaches at effective starch cookers are illustrated in U.S. Pat. No. 5,964,950 to Boling, the present inventor, wherein an external stand pipe is utilized to determine the fluid level within the vessel which, once the batch of starch is cooked and the slurry removed from the tank, residue of the slurry remains within the standpipe and creates an additional impediment to refill water rise in the pipe and erroneous readings occur. The patent also recites the inclusion of a gear pump for recirculating the slurry theorized to materially contribute to the break up of lumps. In operation, it has been found that the gear pump was only marginally effective in the breaking up of starch lumps and also exhibited a tendency to clog. In this previous cooker, it was theorized the use of a gear pump would blend the starch using the gears of the pump as a grinder. Through further operation, it has been found that with the use of gears, the starch revolved around the gears using the gears like paddles around the interior of the body when it was anticipated that the starch would be drawn through the center of the gears and therefore the meshing gear teeth would break up any lumps that had formed in the starch.

Through further evaluation it has been determined that the circulation of the starch with this particular prior art pump was approximately 3 gal per minute. When using straight water in the cook tank, prior to the adding starch, one would observe significant movement of the water in the tank. Once starch was added to this water, the movement due to the viscosity of the liquid slowed down considerably, more so than expected. The gear pump demonstrated the ability to pump on a free flow a maximum rate of 4 gal per minute with a liquid that was very thin such as water.

According to the present invention, the flow rate of the combined mix of starch and water, by using a centrifugal pump of about a ⅓ HP rating, with an inlet size of 1" and an outlet size of ¾", which will pump on free flow about forty gallons per minute using a liquid such as water can provide the flow rate necessary for a thorough mix. Likewise, in the present invention, the inlet and outlet lines of the circulation pump are preferably copper and a minimum of ¾" in diameter. Additionally, an upright filter is installed on the interior floor of the cook tank, extending into the tank, to further assist in the break-up of starch lumps and continual mixing. The filter is also preferably made of copper and stands approximately 6 inches high from the bottom of a 5 gallon mixing tank, a relatively common size of starch cooker. It has been determined that the filter for the 5 gallon tank should contain approximately 30 holes of about ⅛" diameter over its surface to permit sufficient flow, yet break up any concentrations of starch. It has been discovered that with the inventive combination of vortex flow in the tank and the central filter, when water is being mixed into the tank that pump pulls the water off the center bottom of the tank through the filter and back through the side wall of the tank and across the heating coil with a flow of approximately 9 gallons per minute. This flow rate of the centrifugal pump together with the discharge of the heated mixture through the nozzle tangentially to the upper wall of the tank produces a strong vortex through to the center of the cook tank. It is preferable that the pump flow rate establish a vortex swirl around the internal perimeter of the tank with a depth that extends close to, but not below the top of the filter, i.e., such that the filter (and all of the holes) remains covered.

Once starch has been added to this tank, in a normal usage range of from one cup of starch per five gallons of water to 7 cups of starch per five gallons of water (the cup measure is by volume and not be weight) that the variance of mix and the viscosity of these mixtures made little change in the vortex in the center of the cook tank. All of the tests shown each test were in one-cup increasing increment of added starch and shows that there was little change in the depth or angular speed of the vortex in the center of the tank. The importance of this vortex serves many purposes in cooking starch. By radially circulating the starch from the center of the tank and it being drawn across the heating coil at higher rates of speed than conventional cookers, it keeps the heating coil clean, avoiding uneven heating that can occur if starch builds up on the coil. Reliable heating coil operation eliminates any need to subject the starch and water to direct steam injection, and thereby avoiding the troubles induced by such heating. The use of live steam injection not only causes deterioration of the starch water mixture, introduces boiler residue into the mix, but also may be hazardous to the operator. Therefore, it is significant improvement to enable the reliable and uniform heating of the starch by the inventive pumping of the mixture across the self-cleaning heating surface. In earlier such attempts of direct heating, the use of a coil in starch as a heat source failed because the coil did not experience a sufficient flow rate of the starch/water mixture over it and the coil would get coated with starch and the starch would act as an insulator and the coil would cease to transfer heat the starch mixture.

Another advantage of the vortex circulation is found in the effective way any lumps that may form in the starch mixture are pulled to and through the filter in the bottom center of the tank. Lumps are forcibly broken up and the starch dissolved, due to the circulation of the pump continually forcing the mixture past the pump impeller as well as by the draw of the stream through the filter, pulling the lumps through the many small holes in the filter. Also, with this aggressive circulation in a vortex fashion, the starch is now heated evenly throughout the tank without any cold spots. If cold spots are allowed to occur in a cook tank below 180 degrees, there is a danger that the mix will lose its homogeneity and "highlighting" could occur in the garments, resulting in light spots of improperly mixed and cooked starch.

With the selected centrifugal pump used being capable of pumping about forty gallons per minute on free flow, the pump may be adapted by putting approximately 40 lb. of head pressure from a reduced outlet pipe such that the pump the rate drops to 9 gallons per minute. Accordingly, this same pump may be used on smaller starch cookers, such as the described 5-gallon capacity as well as the larger starch cooker being of 14 gallons capacity. This may be accomplished by merely changing the line size from the tank to the pump inlet to change the flow of starch to properly size to the tank capacity. On both tanks a ¾ inch size inlet is preferably used. On the smaller cookers, a ½ inch diameter size outlet is used (contrasted to the larger cooker using a ¾ inch diameter size outlet. Tests of the smaller tanks show that by using ½ inch as an outlet size on the larger cooker that the gallons per minute drop to where the vortex is only slightly visible where on the smaller size cooker, the vortex is maintained relatively as with the larger outlet on the larger cooker. Once the line size had been properly sized for the volume in the tank the vortex was extremely strong and able to disperse any lumps that have appeared in the tank during the test. Once test was over and starch was drained there were no signs of any build up in the tank or on the filter.

On filling, it is common practice to allow water to fill in the tank approximately 6 inches so that starch will not lump or clump against the bottom of the tank due to the tank being hot or any hot starch that my have been left in the bottom of the tank between batches. During testing of the present invention, approximately 2 inches of hot starch was left in the bottom of the cook tank when the "start" button was pressed for the new batch, and at the same time there was added a pre-measured amount of starch into the tank to increase the risk of lumps and during the cooking process. Surprisingly, there were no lumps or clumps visible after the tank was later emptied, due to the strength of the vortex and the capacity of the filter to remove theses lumps and clumps with the high velocity flow which creates the vortex.

Accordingly, the effect of using a centrifugal pump, an immersed heating coil, and a pump strainer, pulling the starch off the bottom center of the tank and injecting it across the coil to form a strong forceful vortex achieve the following:

Removal of lumps and clumps from a starch mixture

Mixing of starch uniformly without cold spots throughout the tank;

Heating the starch mixture, without any fear of exposure to an operator by using methods of directs steam injection;

Heating starch quickly: by injecting the starch mixture across the coil, which keeps the coil free of starch build up.

The present invention thus more quickly and completely cooks a quantity of starch solution required for multiple fills of starch cookers and expeditiously transfers a desired quantity of well cooked, smooth starch reliably to selected cookers than any in the prior art.

BRIEF SUMMARY OF THE INVENTION

An object of the present invention is to provide a new and improved apparatus wherein starch solution may be thoroughly cooked without the liability of forming lumps or solid masses in such a manner to produce a complete homogeneous mixture.

Another object of the present invention is to provide a starch cooking and dispensing apparatus wherein the starch product may be maintained within close limits at the proper temperature for obtaining the best results as to penetration of the garments and the quality of sizing.

Another object of the present invention is to provide a starch cooking/dispensing apparatus that allows commercial laundries to use dry, or uncooked starch which is more economical than other forms of starch and nearly eliminates any waste of starch.

Another object of the present invention is to provide a starch cooking/dispensing apparatus that automatically transfers the hot starch solution directly into a commercial washer. This eliminates the dangerous practice of manual transfer and exposure to burns.

It is yet another object of the present invention to provide a starch cooking/dispensing apparatus that is self-cleaning. The present invention provides an improved apparatus for cooking a starch solution and then dispensing that cooked solution to a commercial laundry washer.

The apparatus includes a vessel with an interior surrounded by a wall for holding a volume of liquid.

A water supply inlet supplies water to the vessel interior for use in making the starch solution.

The vessel provides an open top into which dry starch can be added for making the starch solution.

A steam supply inlet is provided for adding steam to the vessel interior via a header that separates the steam from the solution so that the volume of liquid within the vessel can be heated.

A level controller controls the level of fluid within the vessel in between minimum and maximum fluid levels.

A recirculation flow line provides an inlet and an outlet that each communicate with the vessel interior. A pump mounted in the recirculation flow line pumps fluid from the inlet to the outlet during a recirculation of the fluid within the vessel interior.

In the preferred embodiment, the pump includes a geared impeller that breaks up starch lumps flowing in the recirculation flow line.

A discharge flow line is provided for transmitting the heated slurry of starch and water from the vessel interior to the laundry washer.

In the preferred embodiment, a discharge pump dispenses the heated solution of starch and water from the discharged flow line to the laundry washer, wherein the discharge pump has a geared portion that breaks up starch lumps flowing therethrough.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
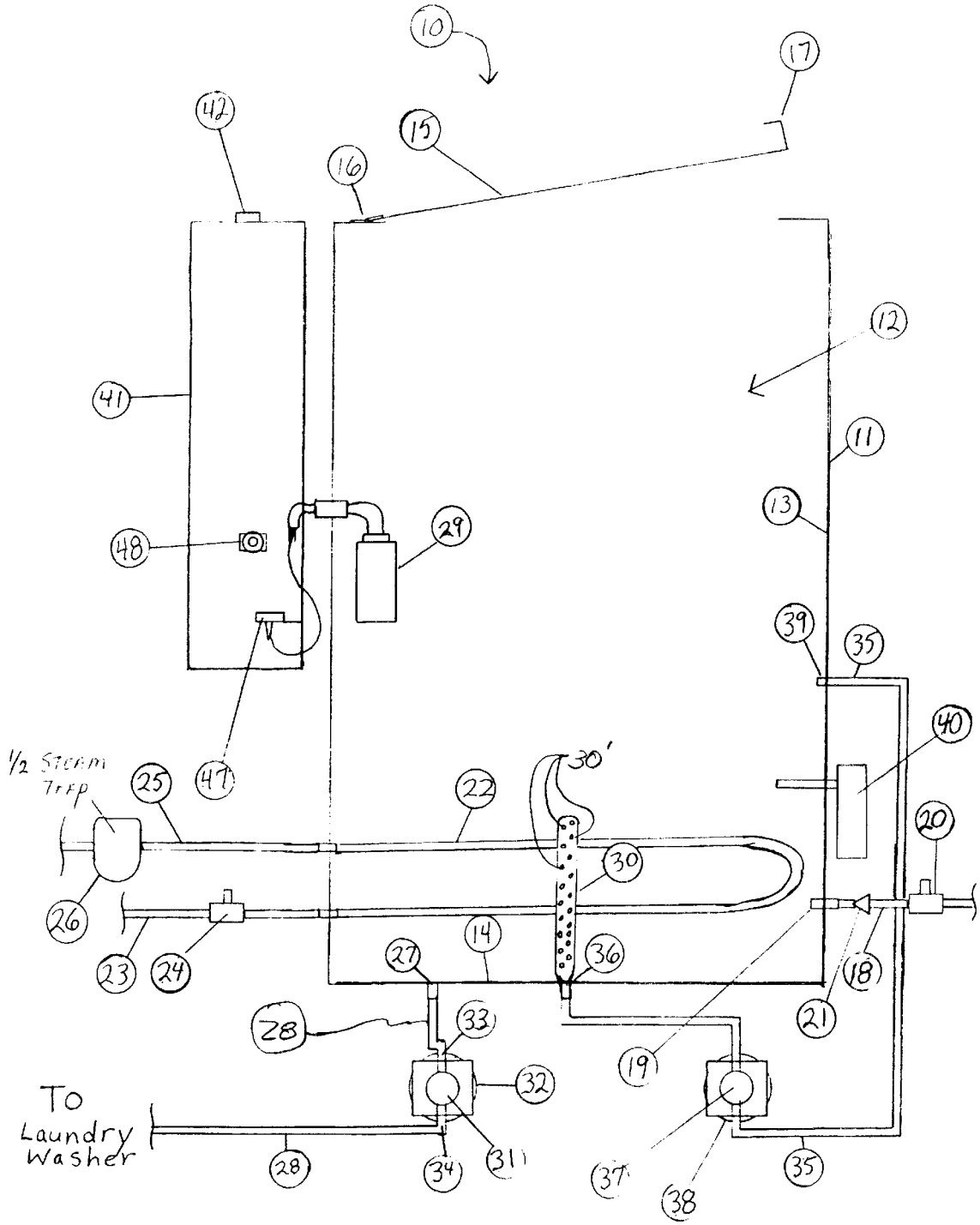
FIG. 1 is a sectional elevational view of the preferred embodiment of the apparatus of the present invention.
Figure 2:
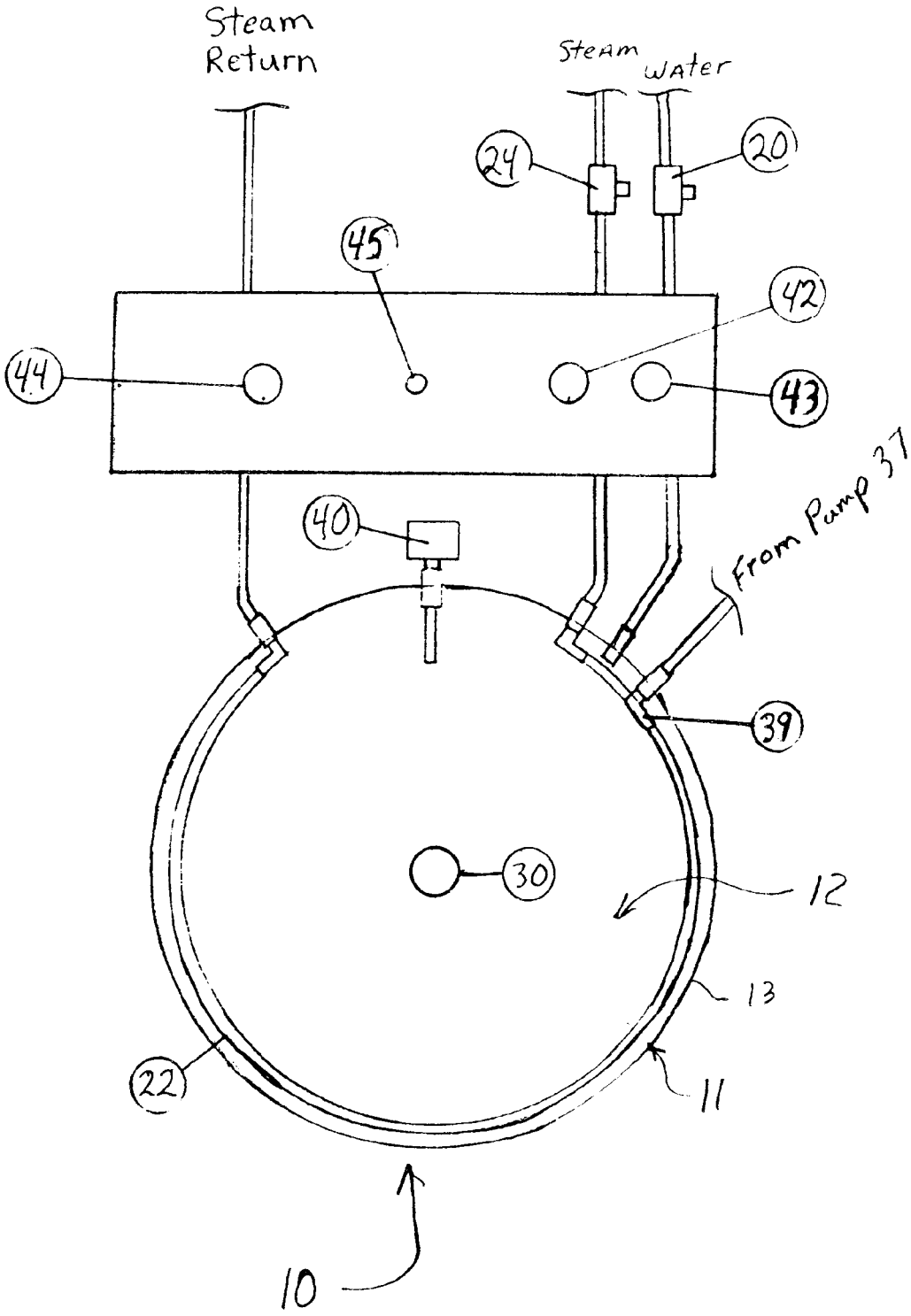
FIG. 2 is a top plan view of the preferred embodiment of the apparatus of the present invention.

FIGS. 1 and 2 show generally the preferred embodiment of the apparatus of the present invention designated generally by the numeral 10. Starch cooking apparatus 10 includes a vessel 11 having an interior 12 for containing water and dry or liquid starch that is added to the vessel through the open top, for example. The vessel 11 provides an interior 12 surrounded by side wall 13 and bottom wall 14. Vessel 11 may be fabricated of a variety of materials suitable for forming a container however, stainless steel or another corrosion resistant material is preferred. The vessel 11 may also be insulated to conserve heating requirements and to reduce the heat lost to the surrounding laundry area. Lid 15 is attached to side wall 13 at hinge 16 so that when the lid 15 is open, starch can be added through the open top portion at the open lid 15. The lid 15 may be provided with a handle 17 to aid in opening and closing the lid 15.

A water supply line 18 supplies fluid to inlet jet 19 when control valve 20 is opened. Preferably, water supply line includes a check valve 21 preventing the back flow of water in the line. Heating coil 22 is a steam header (e.g., ⅜" copper conduit) that tracks in a generally circular path approximately adjacent to side wall 13 as shown in FIG. 2. This heating coil 22 receives steam transmitted to vessel 11 via steam inlet line 23. Steam control valve 24 controls the flow of steam through line 23 to heating coil 22. A steam return line 25 is provided for exiting steam from heating coil 22, the return line 25 being provided with steam trap 26.

After a starch solution has been cooked within the interior 12 of vessel 11, that starch solution can be transmitted to a commercial washer (not shown) via flow line 28. Discharge port 27 communicates with discharge flow line 28 so that the starch solution can be drained from the vessel 11 at discharge port 27. A pump 31 is provided in discharge flow line to assist in the transport of the mixed starch to the commercial washer. In the illustrated embodiment, a Dayton model 7P087 pump and motor is utilized, however those skilled in the art recognize that a pump of similar capacity by another manufacturer will suffice. A motor drive 32 is included to power pump 31 during the transfer of the starch mix to the washer.

A recirculation line 35 is provided to continuously recirculate the starch and water mixture in vessel 11, to initially mix the starch and water combination and to heat the starch to bring it to the necessary useful temperature and homogeneity, and thereafter to prevent the starch from developing any clumps or lumps, keeping it continually ready to be discharged into the commercial washer. Recirculation line 35 terminates in the vessel 11 in the center of the bottom wall 14, at outlet 36, to which is attached filter 30. Filter 30 is a stand of pipe of a noncorosive material, such as stainless steel, which in the preferred embodiment of a cooker having a capacity of 5 gallons the filter is of a diameter of three-quarters of an inch and stands approximately 6 inches above the bottom all 14 of vessel 11. For the standard size cooker being described, the filter has approximately 30 substantially evenly distributed holes which have a diameter of approximately ⅛th inch in diameter, numbering 30, though the height of the filter. The number and size of holes 30' in filter 30 may be varied so long as the flow rate through the filter is essentially equal to the flow rate of the mixture out of the outlet 39. In the described preferred embodiment, pump 37 generates a flow rate of approximately 12 gallons per minute though the system, including through filter 30, through recirculating line 35 and out of discharge nozzle 39 into vessel 11. As may be better noted on FIG. 2, nozzle 39 is disposed adjacent the vertical wall 13 of vessel 11 such that the velocity of the starch and water mixture exiting the nozzle 39 facilitates the vortex set up in vessel 11. Nozzle 39 is immediately adjacent heating coil 22 disposed around and adjacent to vessel wall 13 in the lower region of the vessel 11. By such placement and the vortex assisting action of the discharge of nozzle 39, the starch and water mixture is evenly heated by the continuing flow of starch and water over the heating coil 22. Providing the volume of starch and water flow through filter 30, nozzle 39 and over coil 22 is centrifugal pump 37, disposed in recirculating line 35 immediately below discharge opening 36. In the preferred embodiment, pump 37 is a Dayton model 4RH41 centrifugal pump which provides a flow rate of approximately 12 gallons per minute flow through recirculating line 35 which is approximately ¾ inches in diameter. As previously described, pump 37 operating at rated capacity provides the flow in the recirculating line 35 and out of nozzle 39 into vessel 11, causing the load of the mixture of starch and water to swirl in the direction of flow out of nozzle 39 to a degree that filter 30, at the center of the vortex created, stands approximately 6 inches above the bottom wall 14 of vessel 11 and is barely covered by the mixture of starch and water. For those smaller sized starch cookers described above, the capacity of recirculating pump 37 and the vortex created out of nozzle 39 causes the swirl of the starch and water mixture to bottom just above of the shorter filter 30 for the reduced capacity cooker 10.

As described earlier, nozzle 39 projects the stream of recirculating starch and water generally tangentially of vessel wall 13 across the heating coil 22 to produce the strong vortex which pulls any lumps or clumps of starch into filter 30, causing them to break-up and dissolve as the starch and water mixture transits holes 30' and enters into inlet 36 and pump 37. Projection of the stream of starch and water out of nozzle 39 onto the vessel wall 13 establishes the circular, vortex action which injects the continuous mixing action and impacts the lumps and clumps of starch, to the degree that any persist, against filter 30, forcing them through holes therein. The continuous circular injection of the starch and water mixture tangentially at vessel wall 13 and the extraction of the mixture centrally at filter 30 further inhibits any stagnation of starch in the vicinity of either the steam heating coil 22 or at the bottom of vessel 11, particularly in the region of the outlet port 27. The combination of the described actions ensures a well-mixed homogeneous mixture of starch and water at a uniform temperature selected to provide the best action of starching garments in the commercial washer to which the cooker 10 is connected.

As indicated above, the description is specific to a vessel 11 with a capacity of about 5 gallons. Starch cookers 10 are also commonly constructed with a 14 gallon vessel 11. Other than the size of the vessel 11, the only other adjustment which is made to establish a vortex of sufficient vigor and depth for the above described degree of mixing and heating is by increasing of the size of the outlet on centrifugal pump 37 to ¾ inches compared to the ½ inch size utilized for the 5 gallon vessel. By increasing the flow capacity out of nozzle 39, the described vortex is made to bottom out just above the top of filter 30.

Thermostat 40 regulates the temperature of the starch solution contained within vessel 11 during the cooking period. Thermostat 40 is controlled by control panel 41 illustrated in FIGS. 1 and 2. The Control panel 41 has a start switch 42 to begin operation of cooker 10 and a stop switch 43 to cease operation. A direct transfer switch 44 is provided for initiating the transfer of the contents of the starch solution in vessel 11 to the commercial washer, via flow line 28. Light indicator 45 illuminates when the starch solution has reached the requisite temperature (preferably 180° F. To 190° F.) and the requisite degree of mixing during the cooking operation. Once the operating temperature is reached, timer 48 starts operating and is set to allow mixing for 5 minutes to ensure adequate mixing of the starch and uniformity of temperature in the batch. Once the 5 minutes of continued mixing expire, a ready light 45 illuminates showing that the starch mixture is ready for dispensing.

In the usual cycle for mixing and dispensing a starch and water mixture to a washing machine, the pressing of start switch 42 will start the flow of water into vessel 11 through line 18. The volume of water added is preferably enough to reach a quantity of about five gallons in vessel 11. The fill level is controlled in the preferred embodiment by stand pipe 29, subsequently described. Once vessel 11 is filled to the predetermined level, the user adds from about 8 to about 38 ounces of uncooked (dry) starch. Once the water level reaches the predetermined level as set in water level switch 47, solenoid 20 turns off the supply of water and the steam valve 24 begins supplying steam to coil 22 for the heating of the starch and water mixture. Concurrently, circulation pump 37 is actuated to begin recirculating the liquid in vessel 11 so that the action of the starch and water mixture keeps the heating coil 22 clear of starch build-up and circulation of the mixture through filter 30 breaks up any lumps or clumps of starch. Until the temperature of the starch and water mixture reaches the preselected range, steam solenoid 24 continues the supply of steam to heating coil 22. In the illustrated embodiment, after the mixture has come to the 180–190° F. range, and five minutes have elapsed, the starch and water have become properly mixed and the ready light 45 will illuminate signaling that the mixture is ready for discharge to a washer. Circulation pump 37 will continue circulating the mixture as described and steam valve 24 continues the supply of steam to coil 22 until the commercial washer signals the supply of starch to the washer. At that point, transfer pump 31 begins the transfer of the mixture to the washer.

Cleaning of the cooker 10 is affected in a manner similar to the preparation of a mixture of starch and water, with the exception that the starch is not added. Water is added to the vessel 11 to the predetermined level and is preferably (though not necessarily) heated to the predetermined temperature. The water is circulated as with the mixture since the vortex circulation provides such an effective cleaning action that all of the operative parts are stripped of the previous mixture, and when the cleaning is completed (as with the time it takes for the water to come to the preset temperature and is circulated for the 5 minute period), the water is dumped and the vessel is clean.

The present invention includes an improved water level control which much more effectively and accurately controls the level of water (and the starch mixture) in the vessel 11. Prior versions of cookers have utilized metallic inverted stand pipes 29 within the vessel 11 which operate in conjunction with a pressure switch 47 which senses the level of water in the vessel by means of the pressure exerted on the air trapped within pipe stand 29. It has been discovered that as the level of starch that accumulates upon the exterior of conventional metallic stand pipes affects the coefficient of heat conductance of the stand pipe, and frequently remains there after conventional cleaning. Hence, when a new supply of water is added to the mixer, the rising temperature of the water does not get conducted through the stand pipe 29 and the header of air trapped therein is not heated, as with a clean stand, and therefore the pipe stand gives a level reading (allows overfilling since the air in the tube is not heated and expanded as with the clean pipe) inconsistent with a clean stand pipe. The present invention incorporates a stand pipe 29 fabricated of schedule 80 PVC plastic pipe. By using the selected material (selected because it does not readily conduct heat), the conductance of the heat of the water in the tank is insufficient to change the temperature of the air contained within the pipe stand 29 and therefore, the readings from batch to batch are consistent from one filling to the next since the temperature of the air is essentially constant (i.e., unchanged) and prompts a reliable, repeatable reading.

The following table lists the parts numbers and parts descriptions as used herein and in the drawings attached hereto.

PARTS LIST

| Part Number | Description |
|---|---|
| 10 | starch cooking apparatus |
| 11 | vessel |
| 12 | interior |
| 13 | side wall |
| 14 | bottom wall |
| 15 | lid |
| 16 | hinge |
| 17 | handle |
| 18 | water supply line |
| 19 | inlet jet |
| 20 | control valve |
| 21 | check valve |
| 22 | heating coil |
| 23 | steam inlet line |
| 24 | steam control valve |
| 25 | steam return line |
| 26 | steam trap |
| 27 | discharge port |
| 28 | discharge conduit |
| 29 | inverted pipe stand |
| 30 | strainer |
| 31 | transfer pump |
| 32 | motor drive |
| 33 | pump inlet |
| 34 | pump outlet |
| 35 | recirculation line |
| 36 | outlet |
| 37 | circulation centrifugal pump |

-continued

PARTS LIST

| Part Number | Description |
|---|---|
| 38 | motor drive |
| 39 | inlet |
| 40 | thermostat |
| 41 | control panel |
| 42 | start switch |
| 43 | stop switch |
| 44 | direct transfer switch |
| 45 | light indicator |
| 46 | line |
| 47 | water level switch |
| 48 | timer |

The foregoing embodiments are presented by way of example only; the scope of the present invention is to be limited only by the following claims.

What is claimed is:

1. An apparatus for cooking a starch solution and dispensing the cooked solution to a commercial laundry washer, comprising:

a) a vessel with an interior surrounded by a wall for holding a volume of liquid;

b) a water supply inlet for supplying water to the vessel interior to make a starch solution that includes the volume of liquid and uncooked starch;

c) a steam supply inlet for adding steam to the vessel so that the volume of liquid within the vessel can be heated;

d) a level controller for controlling the level of fluid within the vessel and in between minimum and maximum fluid levels;

e) a recirculation flow line that has an inlet and an outlet that each communicate with the vessel interior;

f) a pump mounted in the recirculation flow line for pumping fluid from the inlet to the outlet for recirculation fluid within the vessel interior, said pump having a an output sufficient to maintain a vortex flow of the solution in said vessel;

g) a filter pipe vertically standing in said vessel connected to the inlet for filtering the starch solution prior to said pump recirculating the solution to the inlet;

h) a commercial washer;

i) a discharge flow line for transmitting a heated starch solution from the vessel interior to a laundry washer; and j) a discharge pump for dispensing the heated starch solution from the discharge flow line to the laundry washer.

2. An apparatus for cooking a starch solution and dispensing the cooked solution to a commercial laundry washer and an access opening for adding dry starch to the interior, comprising:

a) a vessel with an interior surrounded by a wall for holding a volume of liquid;

b) a water supply inlet for supplying water to the vessel interior;

c) a steam supply inlet for adding steam to the vessel interior so that the volume of liquid within the vessel can be heated;

d) a level controller for controlling the level of fluid within the vessel and in between minimum and maximum fluid levels;

e) a recirculation flow line that has an inlet and an outlet that each communicate with the vessel interior;

f) a pump mounted in the recirculation flow line for pumping fluid from the inlet to the outlet and recirculating fluid within the vessel interior so that starch lumps flowing in the recirculation line must flow through the pump;

g) a filter in said vessel connected to the inlet for filtering the starch solution prior to said pump recirculating the solution the inlet;

h) a discharge flow line for transmitting a heated solution of starch and water from the vessel interior to the laundry washer; and i) a discharge pump for dispensing the heated solution of starch and water from the discharge flow line to the laundry washer.

3. The starch cooker and dispenser of claim 2 wherein the steam supply inlet includes a header for receiving steam, the header separating the steam from the starch solution.

4. The starch cooker and dispenser of claim 2 further comprising a pump mounted in the discharge flow line for pumping fluid from the vessel to a laundry washer, said pump having a portion that breaks up any starch lumps flowing in the discharge flow line.

5. The starch cooker and dispenser of claim 2 further comprising a fluid inlet jet for jetting water into the vessel interior so that a vortex flow is generated within the vessel to clean the wall of the vessel.

6. The starch cooker and dispenser of claim 2 further comprising a heating coil that extends around the interior of the vessel next to the wall.

7. The starch cooker and dispenser of claim 2 further comprising a level controller for controlling the level of fluid within the vessel and in between maximum and minimum levels wherein the controller includes an inverted stand pipe fabricated of a material of low heat conductivity.

8. An apparatus for cooking a starch solution and dispensing the cooked solution to a commercial laundry washer, comprising:

a) a vessel with an interior surrounded by a wall for holding a volume of liquid;

b) a water supply inlet for supplying water to the vessel interior to make a starch solution that includes the volume of liquid and uncooked starch;

c) a steam supply inlet for adding steam to the vessel so that the volume of liquid within the vessel can be heated;

d) a level controller for controlling the level of fluid within the vessel and in between minimum and maximum fluid levels;

e) a recirculation flow line that has an inlet and an outlet that each communicate with the vessel interior;

f) a centrifugal pump mounted in the recirculation flow line for pumping fluid from the inlet to the outlet for recirculating fluid within the vessel interior, said pump having a an output sufficient to maintain a vortex flow of the solution in said vessel;

g) a filter pipe vertically standing in said vessel connected to the inlet for filtering the starch solution prior to said pump recirculating the solution to the inlet;

h) a commercial washer;

i) a discharge flow line for transmitting a heated starch solution from the vessel interior to a laundry washer; and j) a discharge pump for dispensing the heated starch solution from the discharge flow line to the laundry washer.

9. The starch cooker and dispenser of claim 8 wherein the water supply inlet comprises a fluid inlet jet for jetting the starch solution into the vessel adjacent the interior wall of the vessel so that a vortex flow is maintained within the vessel.

10. The starch cooker and dispenser of claim 9 wherein the water supply inlet and jet supply the starch solution to the interior of the vessel at a rate of above about four gallons per minute.

11. The starch cooker and dispenser of claim 10 wherein the water supply inlet and jet supply the starch solution to the interior of the vessel at a rate of about five gallons per minute to about 12 gallons per minute.

12. The starch cooker and dispenser of claim 10 wherein the water supply inlet and jet supply the starch solution to the interior of the vessel at a rate of about five gallons per minute to about 40 gallons per minute.

13. The starch cooker and dispenser of claim 10 wherein the water supply inlet and jet supply the starch solution to the interior of the vessel at a rate of about nine gallons per minute.

* * * * *